US006454731B1

(12) United States Patent
Marcantoni

(10) Patent No.: US 6,454,731 B1
(45) Date of Patent: Sep. 24, 2002

(54) MASSAGER TO BE INSERTED IN THE BACK OF A MASSAGE CHAIR OR THE LIKE, PROVIDED WITH MASSAGE PRESSURE ADJUSTMENT

(75) Inventor: Egidio Marcantoni, Pesaro (IT)

(73) Assignee: Ciar S.p.A., Maria (IT)

( * ) Notice: Subject to any disclaimer, the term of this patent is extended or adjusted under 35 U.S.C. 154(b) by 0 days.

(21) Appl. No.: 09/498,722

(22) Filed: Feb. 7, 2000

(30) Foreign Application Priority Data

Apr. 29, 1999 (IT) ..... MI99A0911

(51) Int. Cl.[7] ..... A61H 19/00

(52) U.S. Cl. ..... 601/101; 601/103; 601/99; 601/98

(58) Field of Search ..... 601/115, 116, 601/122, 126, 128, 130, 90, 93, 94, 98, 99, 100, 101, 103

(56) References Cited

U.S. PATENT DOCUMENTS 2,884,923 A 5/1959 Buffalow
3,405,709 A 10/1968 Mathers
5,741,218 A 4/1998 Fujii
6,117,094 A * 9/2000 Fujii ..... 601/99
6,224,563 B1 * 5/2001 Nonoue et al. ..... 601/99

FOREIGN PATENT DOCUMENTS

DE 44 14 196 10/1995
DE 195 05 445 8/1996

* cited by examiner

*Primary Examiner*—Michael A. Brown
*Assistant Examiner*—Benjamin K. Koo
(74) *Attorney, Agent, or Firm*—Guido Modiano; Albert Josif; Daniel O'Byrne

(57) ABSTRACT

A massager to be inserted in the back of massage chairs, comprising a frame which supports a massage assembly constituted by a plurality of massage wheels actuated by at least one gearmotor; the frame is movable in a vertical direction, and the massage assembly is independent of the frame and can move at right angles to a plane in which the frame is formed.

11 Claims, 2 Drawing Sheets

MASSAGER TO BE INSERTED IN THE BACK OF A MASSAGE CHAIR OR THE LIKE, PROVIDED WITH MASSAGE PRESSURE ADJUSTMENT

BACKGROUND OF THE INVENTION

The present invention relates to a massager to be inserted in the back of a massage chair or the like, provided with massage pressure adjustment.

It is known that massagers to be inserted in the back of massage chairs or the like allow to perform massage in various directions, i.e., horizontally, longitudinally along the back of the chair, known as "stretching massage"; massage transversely to the back of the chair, known as "tapping massage"; and so-called "kneading massage".

These massages are achieved by virtue of means for actuating suitable shafts with a rotary motion about their respective axes, so as to produce the alternating movement of massage wheels in a substantially horizontal and vertical direction.

Conventional massagers therefore have a plurality of gearmotors, one for each different actuation of the massage wheels, which are connected, by means of their driving shafts and of adapted lever systems, to the massage wheels, accordingly transmitting thereto the intended motion.

However, one of the greatest problems of conventional massage chair backs is the ability to correctly follow the profile of the back of the user. Commercially available solutions are already known which attempt to solve this problem by acting on the profile of the frame of the device, so as to have a shape which is more or less compatible with the shape of the user's back.

It is known that the massage wheels are supported by a carriage which can move along the frame of the massager; this movement is provided in a longitudinal direction by sliding on a female thread. The limitation of these massagers lies not only in their high cost, caused by the need for complicated lever systems, but also in the fact that the movements of the carriage are highly limited due to mechanical constraints and therefore the sensation transmitted to the user is still very similar to the one found with conventional massagers.

SUMMARY OF THE INVENTION

The aim of the present invention is to provide a massager to be inserted in the back of massage chairs or the like which is capable of maintaining a constant massage pressure.

Within the scope of this aim, an object of the present invention is to provide a massager to be inserted in the back of massage chairs or the like which is capable of accurately following the profile of the user's back in order to maintain a constant massage pressure.

Another object of the present invention is to provide a massager to be inserted in the back of massage chairs or the like which allows adjustment choices which can be programmed directly by the user.

Another object of the present invention is to provide a massager to be inserted in the back of massage chairs or the like which is highly reliable, relatively easy to manufacture and at competitive costs.

This aim, these objects and others which will become apparent hereinafter are achieved by a massager to be inserted in the back of massage chairs, comprising a frame which supports a massage assembly constituted by a plurality of massage wheels actuated by at least one gearmotor, said frame being movable in a vertical direction, characterized in that said massage assembly is independent of said frame and can move at right angles to a plane in which said frame is formed.

BRIEF DESCRIPTION OF THE DRAWINGS

Further characteristics and advantages of the present invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
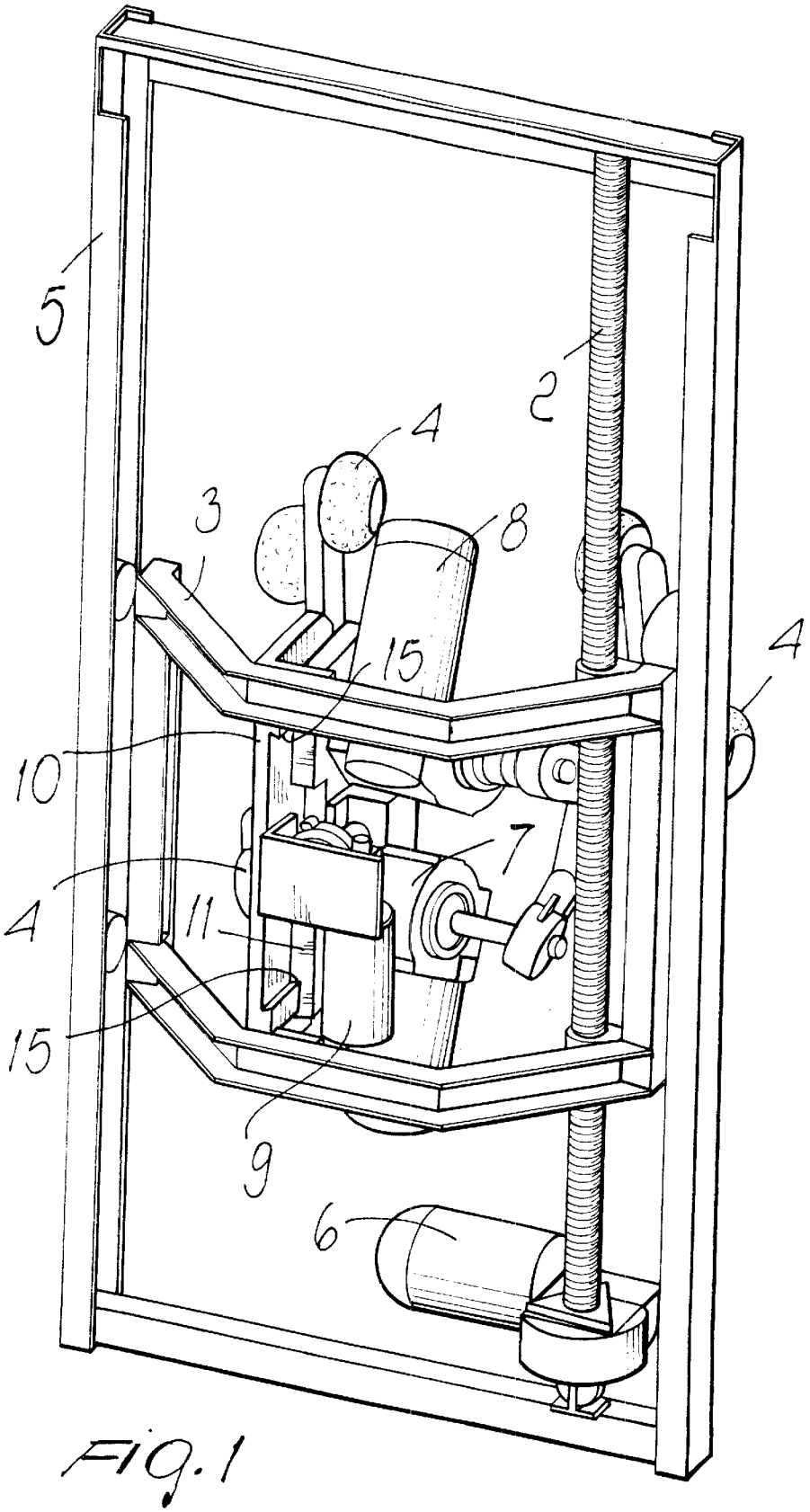
FIG. 1 is a perspective view of the massager according to the present invention.

With reference to the above figures, the massager according to the present invention, generally. designated by the reference numeral 1, comprises a substantially vertical threaded shaft 2 which supports, so that it can slide along it, a movable frame or carriage 3 which in turn supports massage wheels 4 so that they: can rotate about their respective axes.

More particularly, the threaded shaft 2, which according to requirements can be fixed to an adapted chassis, designated by the reference numeral 5, or can be inserted in the back of a massage chair or the like, fixed to the supporting structure of the chair, is rotationally actuated by a gearmotor 6 which is designed to move the frame or carriage 3 vertically along the threaded shaft 2 in order to provide a massage of the stretching type.

A second gearmotor 7 is provided for an oscillating movement of the massage wheels 4, which massage with a tapping motion, similar to the action that a masseur can apply with his fingers, the back of the chair or directly the user's back.

A third gearmotor 8 is instead provided for a transverse movement of the massage wheels 4, with an oscillating component with respect to the longitudinal extension of the threaded shaft 2. This movement provides the so-called "kneading massage".

The particularity of the invention consists in that it provides for a fourth gearmotor 9 which is suitable to produce a movement of the massage assembly (constituted by the gearmotors 7 and 8 and by the corresponding massage wheels 4) in a direction which is perpendicular to the plane on which the chassis 5 is formed.

In particular, the gearmotor 9 is connected, by means of its driving shaft, to a first plate-like element 11 which is rigidly coupled to the massage assembly and is suitable to slide on a second plate-like element 10 (which is rigidly coupled to the carriage 3) so as to face it, for example by means of suitable dovetail slots 15.

In practice, the massage assembly has become independent of the carriage 3, allowing it to move toward and away from the plane on which the chassis 5 is formed.

In this manner it is possible to achieve, along the entire profile of the back of the user, a constant massage pressure which otherwise is not possible with known solutions.

The horizontal movement of the massage assembly, i.e., at right angles to the plane on which the chassis 5 is formed, occurs by means of an electronic controller which detects both the position of the gearmotor 6 and the position of the gearmotor 9, which are conveniently provided with encoders.

The movement, which occurs automatically, can be either preset by a standard factory-set program or can be directly user-programmable by means of a keypad.

Figure 2:
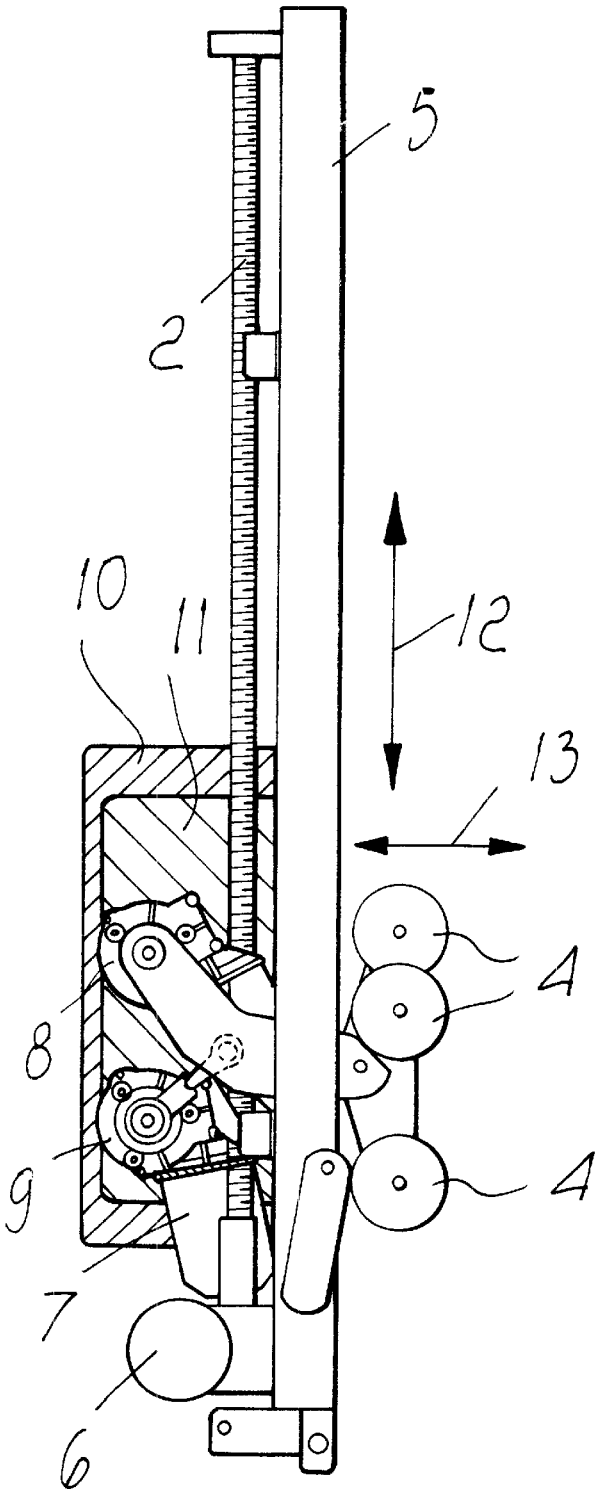
FIG. 2 is a sectional side view of the massager according to the invention.

The arrows shown in FIG. 2 and designated by the reference numerals 12 and 13 respectively illustrate the movement of the carriage 3 along the threaded shaft 2 and the movement of the massage assembly at right angles to the plane on which the chassis 5 is formed.

The sliding of the plate-like element 11 with respect to the plate-like element 10, which is rigidly coupled to the carriage 3, therefore allows the massage assembly to perform a translatory motion at right angles to the normal direction of vertical translatory motion, along the threaded shaft 2, of the carriage 3.

In practice it has been observed that the massager according to the present invention fully achieves the intended aim and objects, since it allows to follow, with the massage wheels, the profile of the user's back while maintaining a constant massage pressure along the entire stroke of the movement of the carriage along the corresponding threaded shaft.

In this manner, the massager does not entail complicated lever systems for the movement of the carriage with respect to the chassis, except in a direction which lies along the threaded shaft 2, thus avoiding the need to move the carriage on a plane which is not parallel to the plane of the chassis in which the carriage is accommodated.

The device thus conceived is susceptible of numerous modifications and variations, all of which are within the scope of the inventive concept; all the details may furthermore be replaced with other technically equivalent elements.

In practice, the materials used, so long as they are compatible with the specific use, as well as the dimensions, may be any according to requirements and to the state of the art.

The disclosures in Italian Patent Application No. MI99A000911 from which this application claims priority are incorporated herein by reference.

What is claimed is:

1. A massager to be inserted in the back of massage chairs, comprising a frame which supports a massage assembly constituted by a plurality of massage wheels actuated by at least one gearmotor, said frame being movable in a vertical direction, wherein said massage assembly is independent of said frame and can move at right angles to a plane in which said frame is formed, and further comprising a first plate-like element which is rigidly coupled to said frame and a second plate-like element which is rigidly coupled to said massage assembly, said means for actuating said massage assembly being connected to said second plate-like element, wherein said second plate-like element is arranged in contact with said first plate-like element and can slide with respect to it, wherein said second plate-like element, actuated by said actuation means, slides by means of slots with respect to said first plate-like element.

2. The massager according to claim 1, wherein said massage assembly comprises actuation means for moving it at right angles to said frame.

3. The massager according to claim 2, wherein said actuation means comprise a gearmotor which is connected to said massage assembly.

4. The massager according to claim 2, wherein the actuation means for actuating said massage assembly comprise an encoder.

5. The massager according to claim 1, wherein said frame is accommodated in a chassis which is adapted to support a threaded shaft for the vertical translatory motion of said frame.

6. A massager to be inserted in the back of massage chairs, comprising a frame which supports a massage assembly constituted by a sub-frame supporting a plurality of massage wheels actuated by at least one gearmotor, said frame being movable in a vertical direction, wherein said massage assembly is independent of said frame and can move at right angles to a plane in which said frame is formed, said massage assembly comprising actuation means for moving said massage assembly at right angles to said frame, said movement of the massage assembly being directed orthogonal to said vertical direction, said actuation means comprising a gearmotor which is connected to said massage assembly, in order to move said sub-frame of the massage assembly with respect to said frame.

7. The massager according to claim 6, comprising a first plate-like element which is rigidly coupled to said frame and a second plate-like element which is rigidly coupled to said massage assembly, said means for actuating said massage assembly being connected to said second plate-like element.

8. The massager according to claim 7, wherein said second plate-like element is arranged in contact with said first plate-like element and can slide with respect to it.

9. The massager according to claim 8, wherein said second plate-like element, actuated by said actuation means, slides by means of slots with respect to said first plate-like element.

10. The massager according to claim 6, wherein said frame is accommodated in a chassis which is adapted to support a threaded shaft for the vertical translatory motion of said frame.

11. The massager according to claim 6, wherein the actuation means for actuating said massage assembly comprise an encoder.

* * * * *